US006237718B1

(12) United States Patent
Schwarzel

(10) Patent No.: US 6,237,718 B1
(45) **Date of Patent: *May 29, 2001**

(54) EXTENDABLE LEG MEANS FOR LEVELLING LADDERS AND THE LIKE

(76) Inventor: Gregory John Schwarzel, 15 Ellen Street, Panania, NSW, 2213 (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/011,012

(22) PCT Filed: Jul. 30, 1996

(86) PCT No.: PCT/AU96/00475

§ 371 Date: Mar. 9, 1998

§ 102(e) Date: Mar. 9, 1998

(87) PCT Pub. No.: WO97/05359

PCT Pub. Date: Feb. 13, 1997

(30) Foreign Application Priority Data

Jul. 31, 1995 (AU) ..... PN 4476
Apr. 2, 1996 (AU) ..... 50449/96

(51) Int. Cl.[7] ..... E06C 1/00; E06C 7/00

(52) U.S. Cl. ..... 182/205; 182/201; 182/204

(58) Field of Search ..... 182/200, 166, 182/201, 170, 203, 202, 204, 205; 242/389; 52/126.1, 126.3, 126.5

(56) References Cited

U.S. PATENT DOCUMENTS 4,014,406 3/1977 Easton ..... 182/204
4,770,275 * 9/1988 Williams ..... 182/202
5,074,378 * 12/1991 Studer ..... 182/201
5,181,584 * 1/1993 Simard ..... 182/201

FOREIGN PATENT DOCUMENTS 6018373 3/1975 (AU) .
1852283 3/1984 (AU) .
285440 12/1952 (CH) .
2327053 12/1974 (DE) .
2528902 12/1983 (FR) .
2151687 7/1985 (GB) .
8607113 12/1986 (WO) .

* cited by examiner

*Primary Examiner*—Alvin Chin-Shue
*Assistant Examiner*—Hugh B. Thompson
(74) *Attorney, Agent, or Firm*—Edwin D. Schindler

(57) ABSTRACT

A leg extension device for use in levelling a ladder or other work platform requiring a level step, includes a first leg member and a second extending leg member, substantially parallel with, and in slidable relation, thereto. A belt, strap or cable cooperates between the first and second leg members to produce an extendable leg, which can be secured, or fastened, over a range of extended lengths by a clamping arrangement, which is operable on the belt, strap or cable. The clamping arrangement is activated to secure the strap in order to fix the length of the extendable leg, or is released, as required, to allow for a positive adjustment by way of either extension or contraction of the extending leg member to accommodate variations in the terrain on which the ladder is used.

20 Claims, 9 Drawing Sheets

EXTENDABLE LEG MEANS FOR LEVELLING LADDERS AND THE LIKE

FIELD OF THE INVENTION

This invention relates to means for levelling ladders and the like including trestles and other work platforms. More particularly, the invention relates to means for quickly and easily extending one or more of the legs of such a ladder or the like and locking or securing the same in position to compensate for any unevenness in the terrain on which the ladder etc is used, so that a stable and safe use of the ladder or like is achieved.

BACKGROUND OF THE INVENTION

Although the following description refers generally to ladders, no limitation is intended thereby. Any related device including, but not necessarily limited to, step ladders, extension ladders, trestles, work platforms, scaffolding, sawhorses, workbenches and other work tables etc having leg members (including picnic tables and the like), wherein such device is normally required to be set on level ground to provide a level step, platform or other level work area in order to be safely used, is also contemplated. The invention may also be employed in other circumstances where extendable legs or their equivalent are required, whether or not a levelling of the device itself is paramount or even achieved. For example, it is well known to use so-called strutting devices (ie a single leg member) which can be extended and locked in such extended position to provide temporary support, for example to jack up beams or sheets of cladding during construction. Such devices would also benefit from use of the invention therein.

Of necessity, ladders are used on a variety of surfaces and in many instances the ground or surface on which they are used is uneven, sloped or stepped. Conventional ladders having fixed length legs are rendered unsafe by even the slightest unevenness, particularly where longer lengths of ladder are involved, as the weight loading in relation to the centre of gravity is paramount. In other words the higher one goes on a non level ladder, the greater the danger there is of overbalancing. In the past it has been necessary to chock up one or more legs of a ladder to overcome any unevenness in the terrain. However, this also renders the use of the ladder relatively unsafe as the chock itself may move, or the ladder can otherwise slip off it, with disastrous consequences.

In order to overcome the inherent lack of safety and other difficulties in using blocks and chocks etc, attempts have been made to produce so-called ladder levelling devices. Conventional ladder levellers are usually add-on devices which can be expensive and cumbersome. In any event, to safely level a ladder using previously known devices, it is generally necessary that the person intending to use the ladder do so in a standing position, whilst operating the relevant mechanism, and at the same time sighting a gauge or level and maintaining the overall stability of the ladder. In many instances this can be a complex task, given the degree of adjustment required for known ladder levelling devices.

It would therefore be extremely advantageous to provide a simple means of levelling a ladder, which is relatively easy to use and which is itself extremely safe to use.

OBJECT OF THE INVENTION

The present invention has therefore been conceived out of the need to provide a relatively inexpensive but safe, easily operable means or mechanism, whereby each of the legs of a ladder or similar device can be independently extended to accommodate any unevenness in the terrain on which the ladder is to be employed. At the very least, the invention provides an alternative to presently known methods of levelling ladders and the like.

Although the present invention allows an integrated approach to the problem, in so far as the levelling device may be integral (ie built-in) to the ladder or other device, the invention may also be utilised as an add-on feature for an otherwise conventional ladder or device having legs, where by suitable modification the invention may also be employed.

DISCLOSURE OF THE INVENTION

According to the present invention there is provided a leg extension means providing independent extension for a single leg, suitable for use in levelling a ladder or other device requiring a level step, work platform or the like, or otherwise suitable for use in providing variable extension to the leg, comprising a first leg member and a second single extending leg member substantially parallel with and in slideable relation therewith, a belt, strap, cable or the like co-operating therebetween and a clamping arrangement operable on the belt, strap, cable or the like to produce an extendable leg which can be secured or made fast over a range of extended lengths and wherein the clamping arrangement may be activated to extend the extending leg member and to secure the said belt, strap, cable or the like in order to fix the length of the extendable leg, or released as required to allow adjustment by way of either extension or contraction of the extending leg member to accommodate variations in the terrain on which the ladder or other device is used.

Preferably, the leg extension means is telescopic in arrangement, the first leg member comprising either a hollow tube or having other suitable cross section (for example a C-shaped cross section) to otherwise contain the second extending leg member, so that in the unextended state, the second extending member is substantially contained within the first member, whilst in the fully extended state, one end portion of the second member remains within the first member and is supported thereby to a sufficient degree that the leg remains substantially rigid in use.

Alternatively, with advantage, the extending leg member may be located about the first leg member, which arrangement is particularly suited when the leg extension means is an add-on to an existing ladder or the like.

As a further alternative, the second extending leg member may be located adjacent and alongside the first leg member and slideable within hook or loop like elements, fixedly attached and substantially perpendicular to the first leg member, the said hook or loop elements providing sufficient containment of the second extending member as described above.

It is generally preferred that the clamping mechanism be located on the first leg member rather than the extending leg member. More preferably the belt, strap or cable passes about a pulley or guide arrangement located on the same member as the clamping mechanism, to facilitate easier operation of the clamping device by locating it in a more suitable location than would be possible without utilising such pulley or guide. In other words, in one version of the simplest form of the invention, the belt, strap or cable is fixedly attached by one end at or near to the top portion of the extending member, the belt simply passing down the extending leg member. between it and the first leg member which lies adjacent to it over sufficient of its length to maintain its stability, to a clamping means located on the first leg member, which of necessity would therefore be located towards the free end of that first leg member. However, operation of the clamping device would normally be more difficult if thus located, as it would be relatively near the ground in a typical use situation. On the other hand in certain situations where in fact the "leg" extends upward, eg in the aforementioned strutting device, in which an extending member is caused to be extended upwards from first "leg" member in the form of a base support unit, the location of the clamping device adjacent the free end thereof may in fact be more practicable. Nevertheless, for the bulk of applications, in which the extending member is extended downwards to lengthen a more conventional leg, such arrangement would not be so convenient.

Therefore, instead, in a preferred form of the invention, the belt, strap or cable is fixedly attached by one end at or near to the top portion of the extending member as described above, the belt passing down and around a single pulley or fixed guide, for example in the form of a bar, located on the first leg member, from whence it progresses upwards towards the clamping device located at a more convenient position on the first member. By pulling upwards on the belt in the vicinity of the clamping device (rather than downwards as is the case in the first simple arrangement, at least in relation to the conventional orientation of a leg), the second extending member will be caused to travel downwards due to the tension exerted by the belt, thereby extending the leg. Upon clamping the belt in suitable fashion, the extending leg member will be restrained from returning, ie moving upwards.

Although in such arrangements as described, the free end of the belt may remain free, ie merely pass though the clamping device, this is not only untidy but has the disadvantage that manual effort is required to pull on it in order to cause the extending leg member to move so that the leg is extended.

Therefore it is especially preferable that the clamping means be provided in the form of a spool and ratchet device, capable of winding up the otherwise free end of the belt. Thus the ratchet operates in a first operating position to allow the spool to be rotated in one direction whereby the belt is wound up with the consequence that the extending leg member moves downwards and causes the leg to be extended. Upon being left in such position the ratchet secures the spool and hence the belt against slippage, thereby maintaining the leg in extended position. The ratchet however is able to be set in a second release or free position to release the spool and consequently the belt for retraction of the extending member. Retraction of the extending leg member may be achieved simply by virtue of the weight of the ladder or other device acting downwards on the extended leg. However with advantage, retraction may be facilitated by the use of a return spring or other suitable elastic means, eg a shock cord or bungee style cord to assist such return even when the ladder's own weight is not acting on the leg, eg the ladder is lifted from the ground at least at that leg, or is otherwise positioned so that no weight is supported on the leg (eg it is lying down). It will be appreciated that the return spring or shock cord not only acts to return the extending leg member to its retracted position, but also acts to prevent the extending member from falling out of or away from the first leg member when the ladder or other device incorporating the extending leg mechanism is lifted from the ground.

By locating the ratchet device at suitable positions on the stile or upright leg of the ladder it will be appreciated that adjustment may be achieved by operating the ratchet at say shoulder height on the ladder. This enables the ladder to be levelled whilst holding the ladder in a position that is stable and safe. It will also be understood that the belt or strap may be further extended by means of other suitable pulleys or guides located as required, so that the clamping device may be suitably located at a position more remote from the leg to be extended, but otherwise perhaps located at a position which is more convenient for the purpose of operating say a step ladder with four extendable legs. Thus it is possible to locate all four clamping devices, eg ratchets, necessary to conveniently level a step ladder on the front stiles of the step ladder adjacent say the shoulder height of a standard operation.

Actuation (ie extension) as well as retention of the device in extended mode is thus achieved with the use of belts, straps, cables or the like in tension. The tension action allows continuous adjustment over the design range of the device. Actuation (extension) of the ladder is thus readily achieved in the most preferred embodiment by means of ratchet mechanisms as described, which are as remote from the extending leg members as necessary and which are situated preferably at shoulder height, using such straps in tension which run from the ratchet mechanisms to each respective leg. The ratchet mechanisms (or other retracting and/or clamping devices) may be situated anywhere on the ladder (ie any stile, leg, rung, or tread) depending upon the design requirements of the individual ladder. Secondary locking devices may also be provided in conjunction with the aforementioned clamping device to achieve additional safety.

The belt or cable may be of any suitable material of sufficient strength to accommodate the expected load in used. One such suitable material is nylon (or similar) strapping or webbing as used in seat belts, safety harness and parachutes. Any pulley or guide used in conjunction with the belt or cable may be any suitable rotatable pulley or fixed guide, for example in the form of a bar, about which the belt or cable may be guided and which allows it to slide without appreciable wear.

The leg extension mechanism may be an integral component of the ladder or fitted to an existing ladder as an add-on. In the case of an add-on arrangement, suitable means for affixing the extendable leg include, but are not necessarily limited to, the use of bolts, screws or rivets. Although the leg members of the extension mechanism will normally be manufactured from the same material as the ladder or other device when it is integral therewith, in those circumstances where it is provided as an add-on facility, they can be suitably manufactured out of aluminium, plastics, fibreglass, pressed metal, carbon fibre or any other suitable material as required.

In another form of the invention there is provided a ladder, trestle or other device having one or more legs, comprising one or more leg extension means associated therewith, suitable for use in levelling the ladder or other device requiring a level step or work platform or the like, wherein the leg extension means are as described above.

With advantage, the ladder or other device has a built in level indicating device (preferably at a convenient location eg eye level) to indicate when it is level. This can be accomplished for example in the case of a step ladder by providing a suitable level indicating device in the top or uppermost step.

The leg extension mechanism according to the invention can be used on a variety of ladders eg step ladders, extension ladders, platform ladders. By operating independently on each leg, the present invention provides an improved ladder levelling device which can be readily used on all ladders of different sizes, widths and heights. It can also be used on four legged step ladders as well as two legged extension ladders. By utilising the invention, each leg of the ladder will have a continuously variable adjustment and this allows a step or extension ladder to be used safely on surfaces with slopes up to at least 16 degrees laterally and at least 7 degrees fore and aft. These angles are only restricted by the amount of extension provided in the leg extension means and standard safety limits. It has been found that an operating range of say between 0 mm to 250 or 300 mm extension is sufficient for most purposes, however the range of such extension is only limited by common sense in applying normal design constraints and taking safety considerations into account.

As mentioned before, the device is not limited solely to adders but has applications in scaffolding and other building products such as saw horses, work benches, strutting devices, etc. It may also be used on garden or picnic furniture or indeed any other application involving the need to level an item having legs, eg furniture, the use of which would be greatly enhanced if it could be utilised safely, ie made level, on otherwise unlevel ground.

BRIEF DESCRIPTION OF THE DRAWINGS

Embodiments of the present invention will now be described with reference to the drawings in which.

BEST MODE OF CARRYING OUT THE INVENTION

Figure 1:
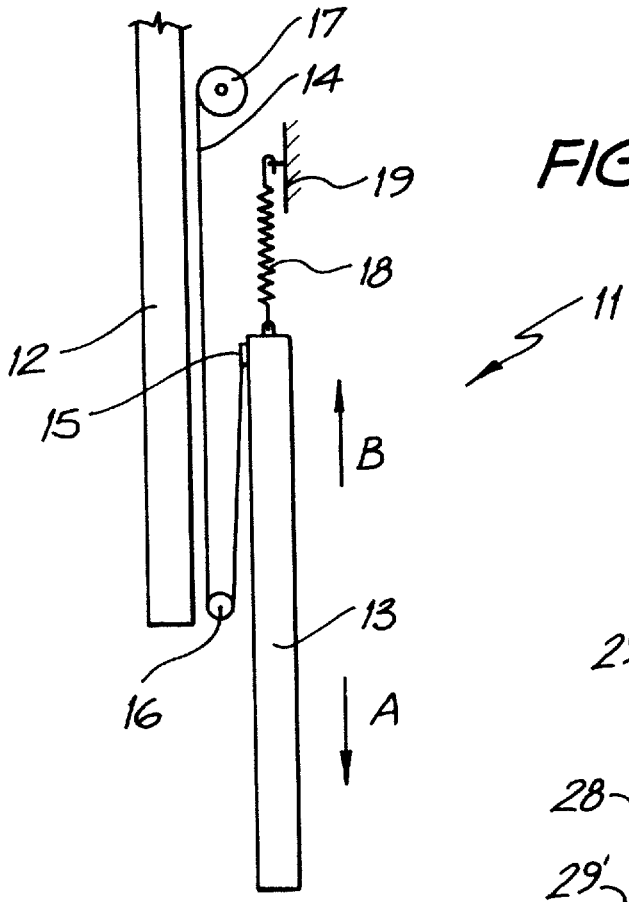
FIG. 1 is a schematic representation of a leg extension mechanism for a ladder or the like in which a return roller is provided.

Referring to FIG. 1, there is shown in schematic form a leg extension mechanism generally referenced 11, comprising a first leg member 12 and a second extending leg member 13. Located therebetween is a strap 14 fixedly attached at a point 15 adjacent the upper end of the extending leg member 13 by suitable means. The strap 14 passes from there around a pulley or guide 16 and thence to a ratchet device 17, located at a suitable position on the first leg member 12. A return spring 18 is located between any suitable point eg at the upper end of the extending leg member 13 and a fixed point 19 located elsewhere on the device eg ladder (not illustrated) which incorporates the leg extension mechanism 11.

It can be seen that if the strap 14 is shortened by means of the ratchet mechanism 17, the extending leg member 13 will be caused to move downwards in the direction of arrow A, thereby extending the overall length of the leg extension mechanism 11. The strap 14 will be held in this position by virtue of the appropriate orientation of the ratchet mechanism 17, the strap 14 remaining in tension as a result of the influence of spring 18 and/or the weight of the ladder or other device incorporating the mechanism 11 resting thereon in use. If the ratchet 17 is released, it will allow the extending member 13 under the influence of return spring 18 and/or the load exerted by the device such as the ladder in use, to pull against the unrestrained strap 14 and to move in the direction of arrow B, ie to be retracted, thereby shortening the overall length of the leg extension mechanism 11. By locating such a mechanism on each leg of a ladder for example, adjustment of the height of each leg of a ladder is allowed in order to bring the ladder into a level position.

Figure 2:
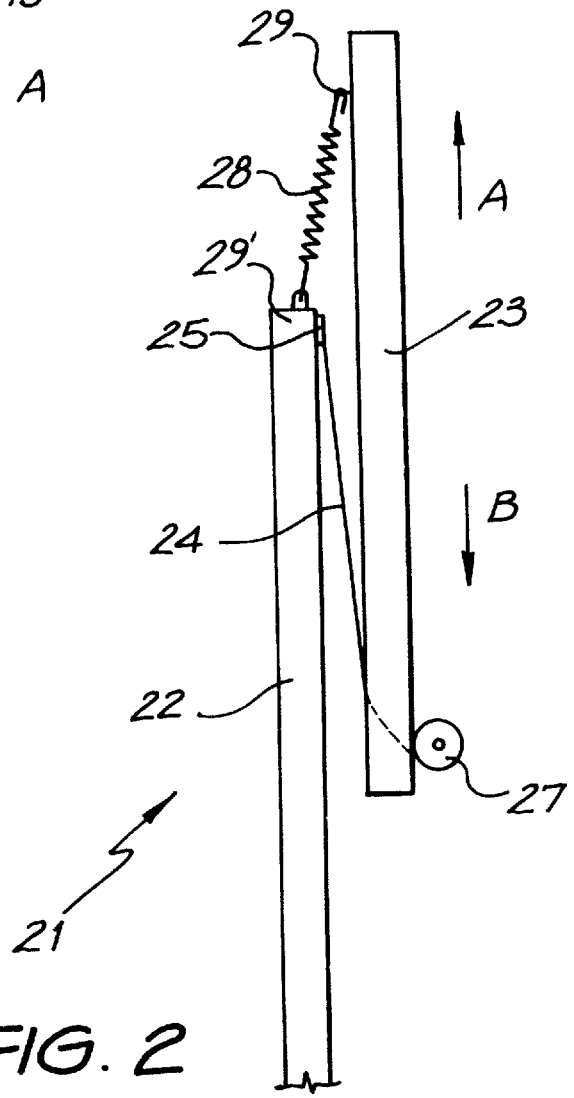
FIG. 2 is a schematic representation of a leg extension mechanism suitable for use in a strutting device, wherein no return roller is required.
Figure 3:
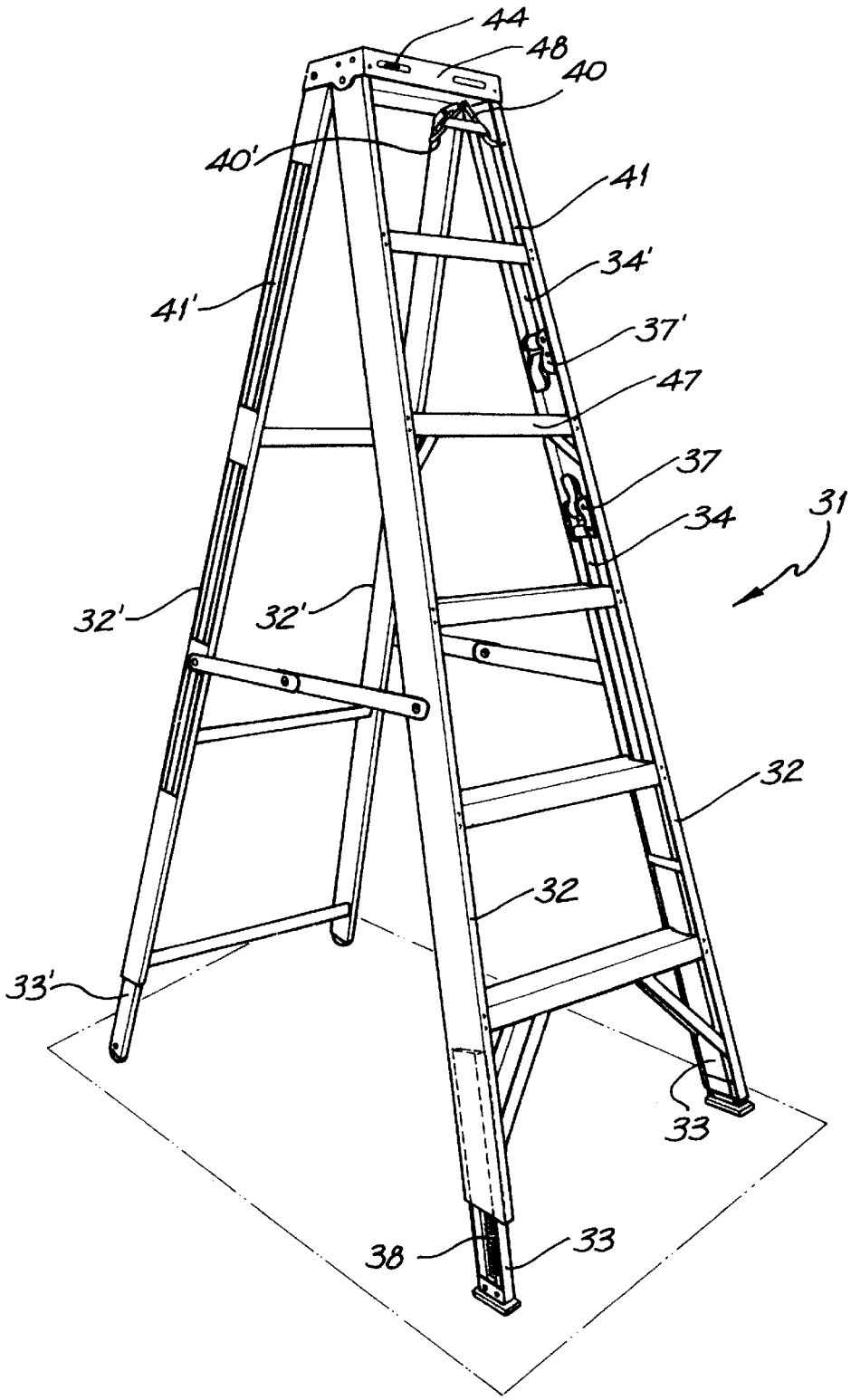
FIG. 3 is a perspective view of a step ladder incorporating four leg extension mechanisms or levelling devices, one per leg of the ladder, showing how the invention is incorporated and protected internally within the ladder.

Referring to FIG. 2, there is shown in schematic form a leg extension mechanism generally referenced 21, which is particularly suitable for a strutting device (not illustrated in detail) to support beams and sheeting during construction. The mechanism 21 comprises a first "leg" or base support member 22 and a second extending leg member 23. Located therebetween is a strap 24 fixedly attached at a point 25 adjacent the upper end of the base support member 22 by suitable means. The strap 24 leads directly from there to a ratchet device 27 located in this particular embodiment on the extending member 23. A return spring 28 is located between a point (reference numeral 29) on or near the upper end of the extending leg member 23 and a point (reference numeral 29') located elsewhere on the device, e.g., adjacent the end of the support base member 22.

In this embodiment, it can be seen that if the strap 24 is shortened by means of the ratchet mechanism 27, the extending leg member 23 will be caused to move upwards in the direction of arrow A, thereby extending the overall length of the leg extension mechanism 21. The strap 24 will be held in this position by virtue of the appropriate orientation of the ratchet mechanism 27, the strap 24 remaining in tension under the influence of the return spring 28 and/or the weight of the extending leg member 23 itself. If the ratchet 27 is released, it will allow the extending member 23 under the influence of return spring 28 and/or its own weight to pull against the unrestrained strap 24 and to move in the direction of arrow B, ie to be retracted, thereby shortening the overall length of the leg extension mechanism 21. By locating such a mechanism on each leg of a ladder for example, adjustment of the height of each leg of a ladder is allowed in order to bring the ladder into a level position.

Figure 10:
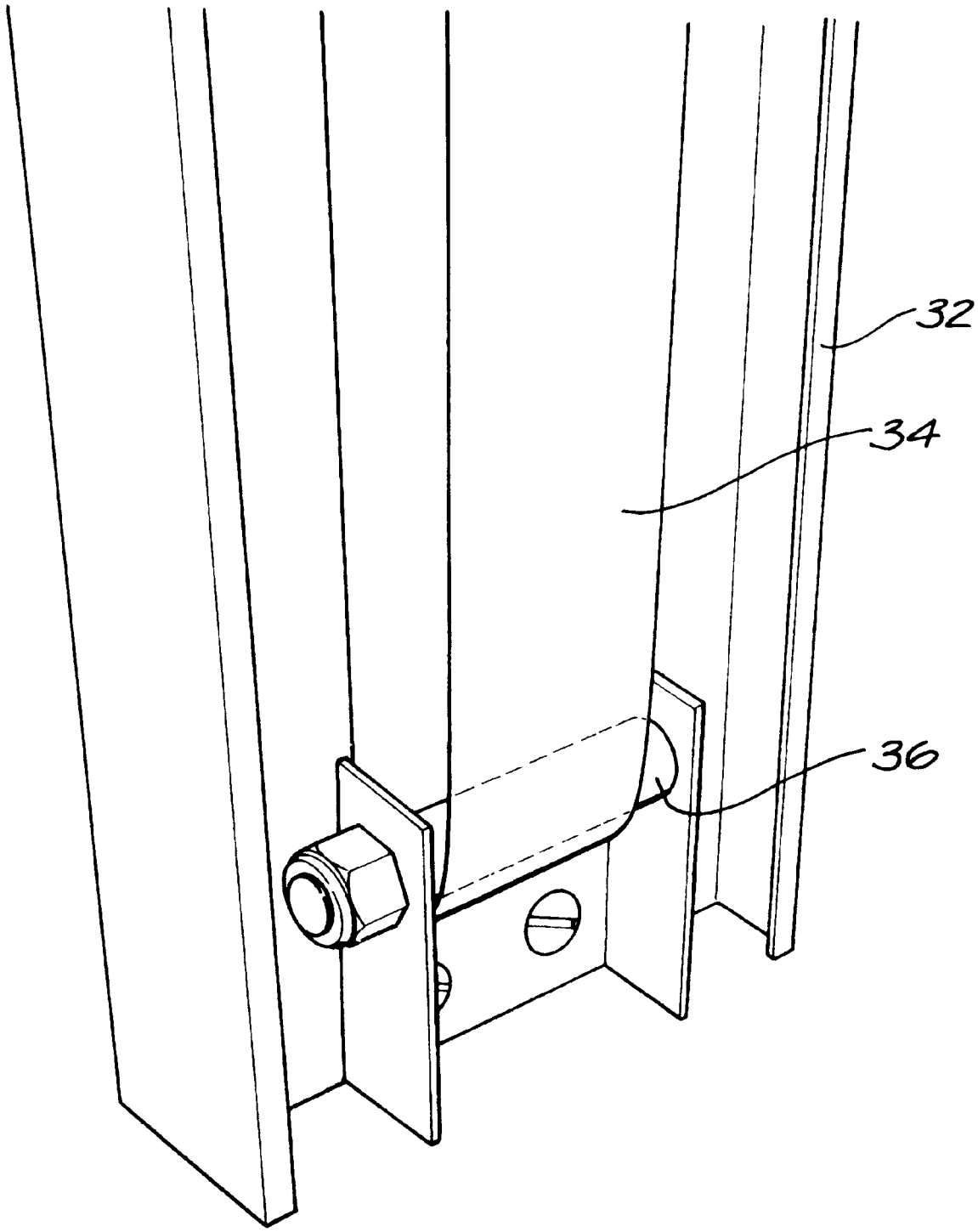
FIG. 10 is a detailed view of the return roller (modified as required) suitable for use in any either the embodiment described in FIGS. 3 to 7 or in FIGS. 8 and 9.

Referring generally to FIGS. 3 to 7, there is shown a step ladder incorporating leg extension mechanisms generally referenced 31. The ladder 31 comprises first leg members 32 (front) and 32' (rear) and second extending leg members 33, 33', with steps or treads 47 located between the respective left and right front leg members 32. Other parts of the adder 31 not relevant to the invention are not referenced. Located between the respective first (32, 32') and second extending leg members (33, 33') are straps 34 and 34' fixedly attached at points 35 (only shown in FIG. 7) adjacent the upper ends of the extending leg members 33, 33' by suitable means. The straps 34, 34' pass from there around guides 36 (only shown in FIG. 7 or in greater detail in FIG. 10) and in the case of rear straps 34' further return bars 40 and 40 located at the juncture of the front and rear first leg members 32 and 32' respectively, and thence to respective ratchet devices 37 and 37', located at suitable positions on the first front leg members 32 only. In other words, return bars 40, 40 allow transfer or change in direction of the rear strap 34' directly from the rear extending leg member, up a deep channel 41 in the rear leg member 32' and down a further deep channel 41 in front leg member 32 to the ratchet device 37', which operates on the rear extending leg member 33', although it is located on the front leg member 32.

A level indicating device 44 is conveniently located on top step 43.

Figure 7:
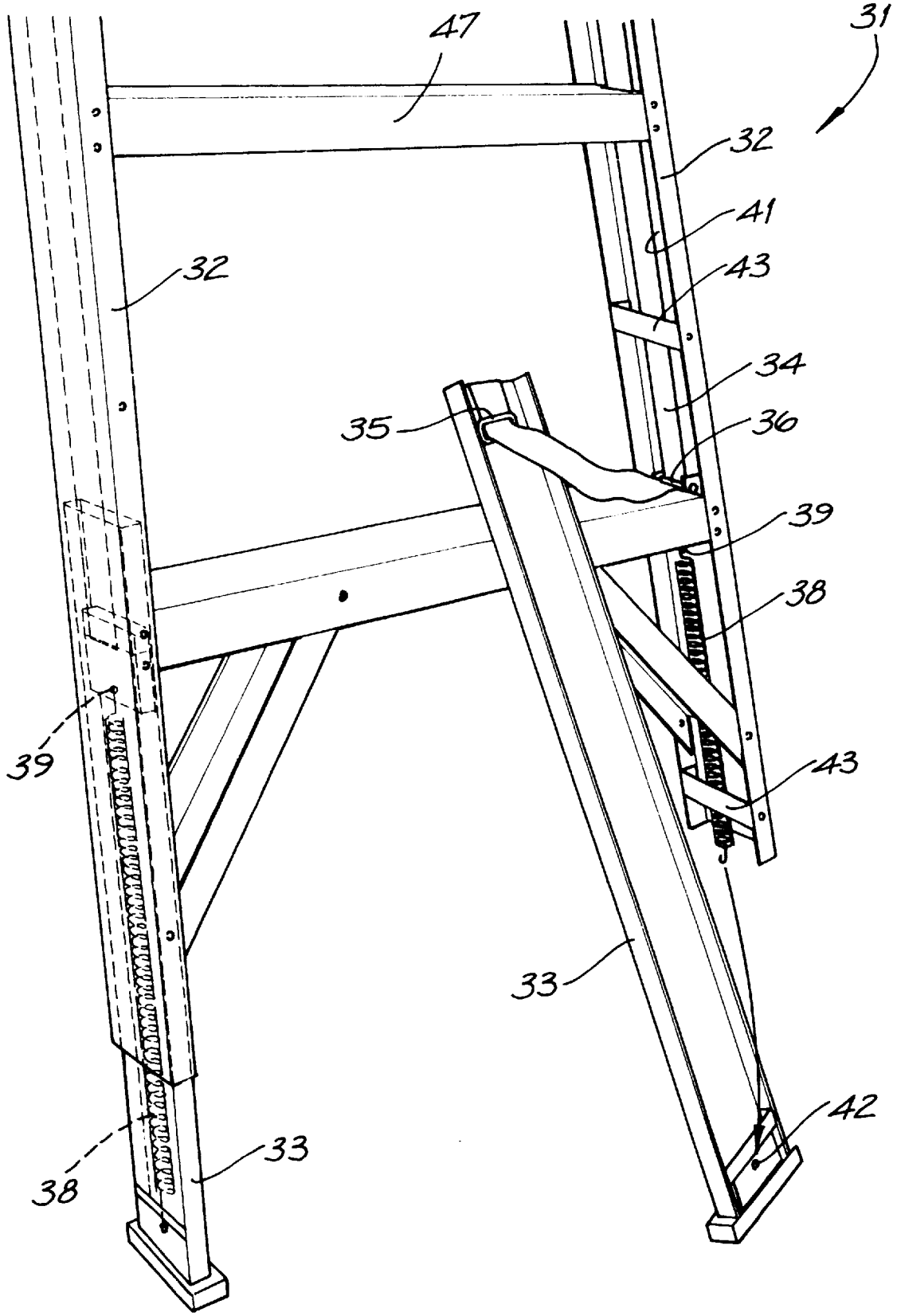
FIG. 7 is an exploded perspective view of the embodiment illustrated in FIG. 3, showing the extending leg member removed.

Referring specifically to FIG. 7 in particular, where the extending leg member 33 has been removed, a return spring 38 is located between the lower end 42 (not affixed thereto in the illustration) of the extending leg member 33 and a fixed point 39 located on the respective first leg member 32. The return or tension spring 38 acts to stop the extending leg member 33 from falling out when no load is placed on the ladder 31. Guide bars or retaining brackets 43 assist in restraining the extending leg member 33 when located therein.

Figure 4:
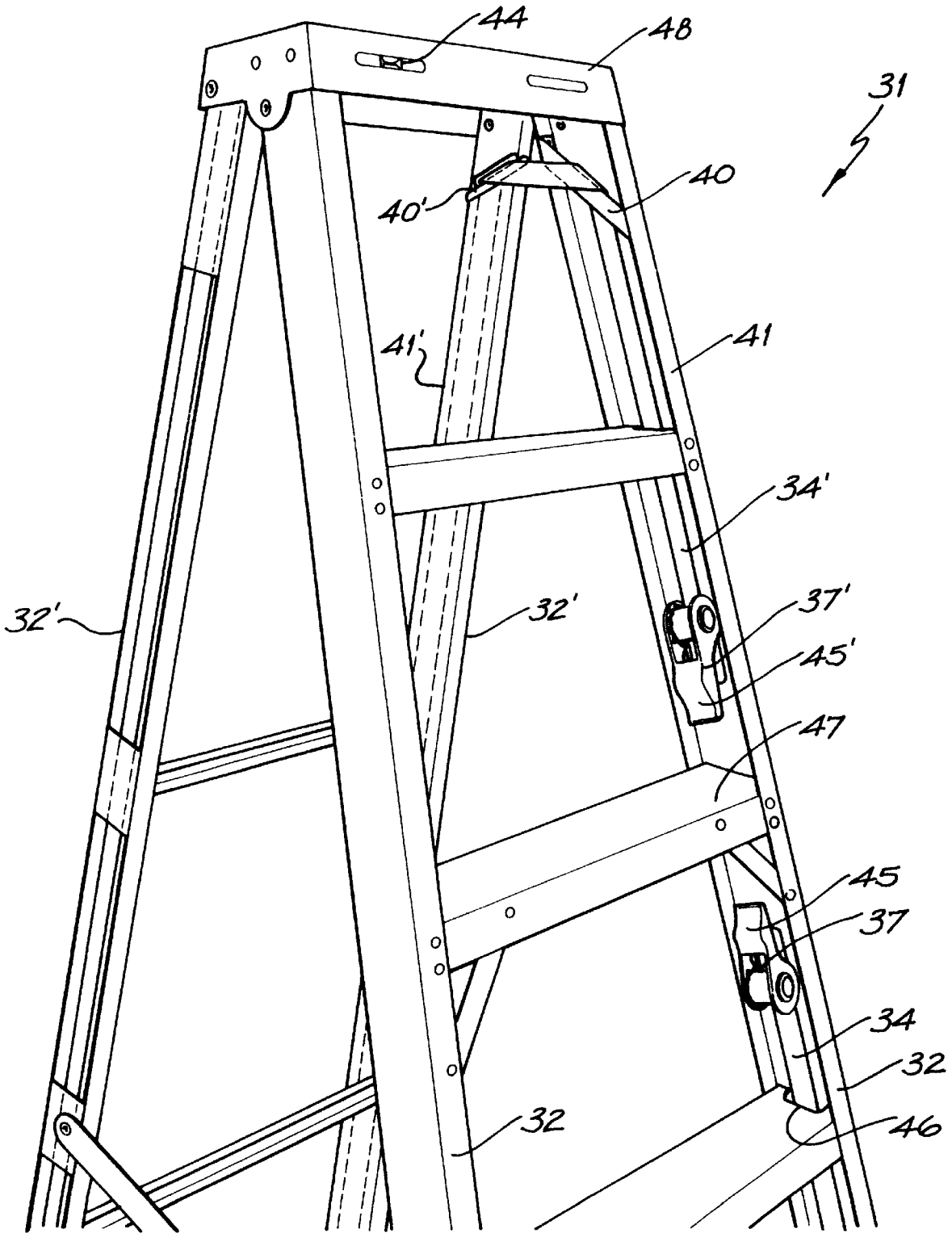
FIG. 4 is a detailed perspective view of the embodiment illustrated in FIG. 3, showing the location of the ratchets or retracting devices used to extend the pair of legs on the right hand side of the ladder.
Figure 5:
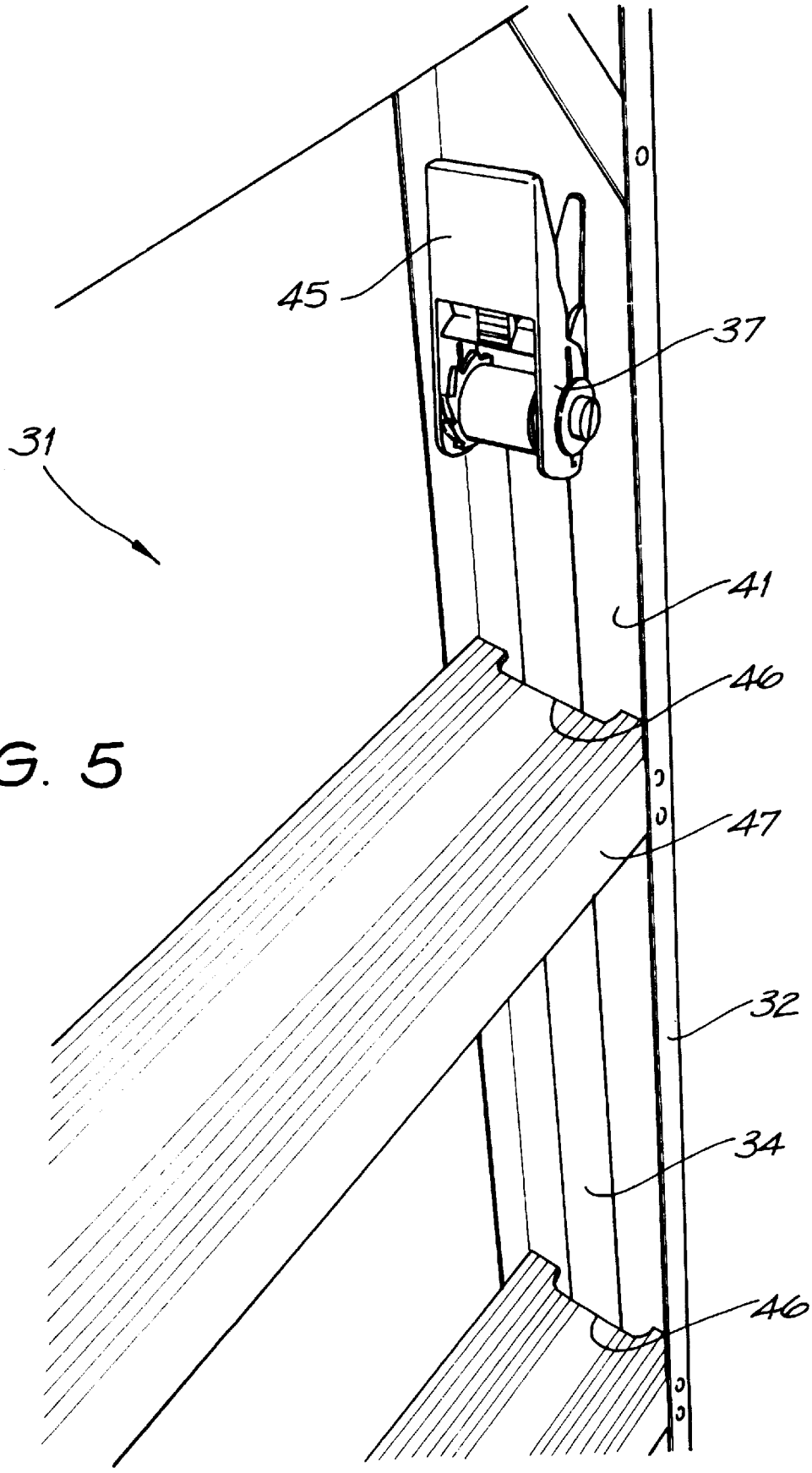
FIG. 5 is a detailed perspective view of the ratchet or retracting device used to extend the front right leg of the embodiment illustrated in FIG. 3, showing how the strap runs internally down the stile of the ladder, the treads of the ladder having notches to accommodate the strap.

The ratchet devices 37, 37' are shown in more detail in FIGS. 4 to 5, in which it will be observed that actuation of the respective ratchet by means of handle 45 or 45' will cause the strap 34, 34' to be wound up, ie shortened, causing the respective extending leg members 33, 33' to extend. The straps 34, 34' will be held in this position by virtue of the appropriate orientation of the ratchet mechanisms 37, 37', the straps 34 and 34' remaining in tension as a result of the influence of springs 38, 38' and/or the weight of the ladder 31 itself in use. When ratchets 37, 37' are released, it will allow the extending members 33, 33' under the influence of return springs 38, 38' and/or the load exerted by the ladder 31 in use, to pull against the unrestrained straps 34, 34' and to retract, thereby shortening the overall length of each leg of the ladder 31.

Figure 6:
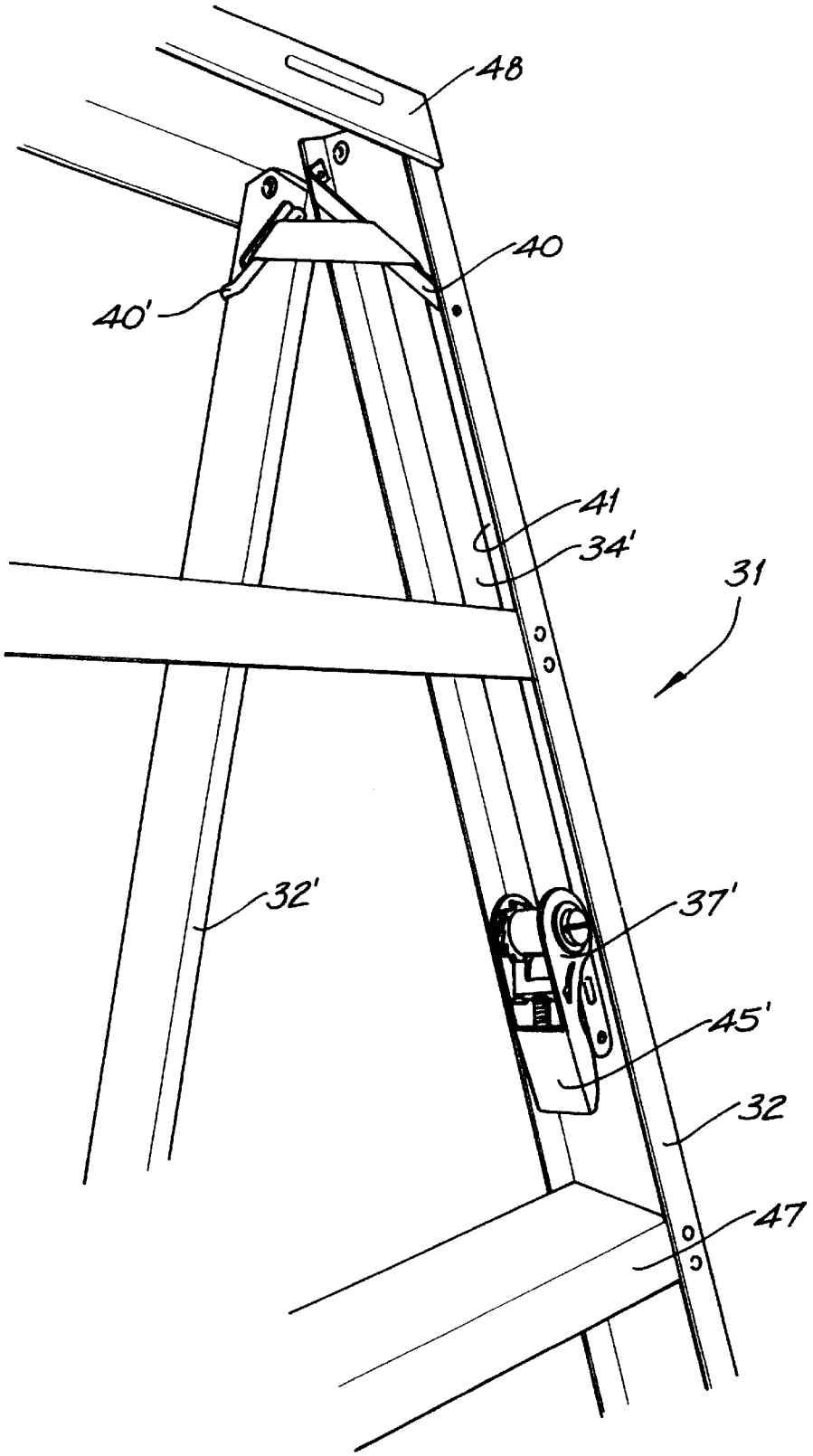
FIG. 6 is a detailed perspective view of the ratchet or retracting device used to extend the rear right leg of the embodiment illustrated in FIG. 3, by means of a strap which transfers to the rear leg via a top guide bar.

Also shown in more detail in FIGS. 4 to 6 is the notch 46 made in the end of each tread 47 of the ladder 31, in order to accommodate the strap 34 as it passes down the respective leg members 32.

Figure 8:
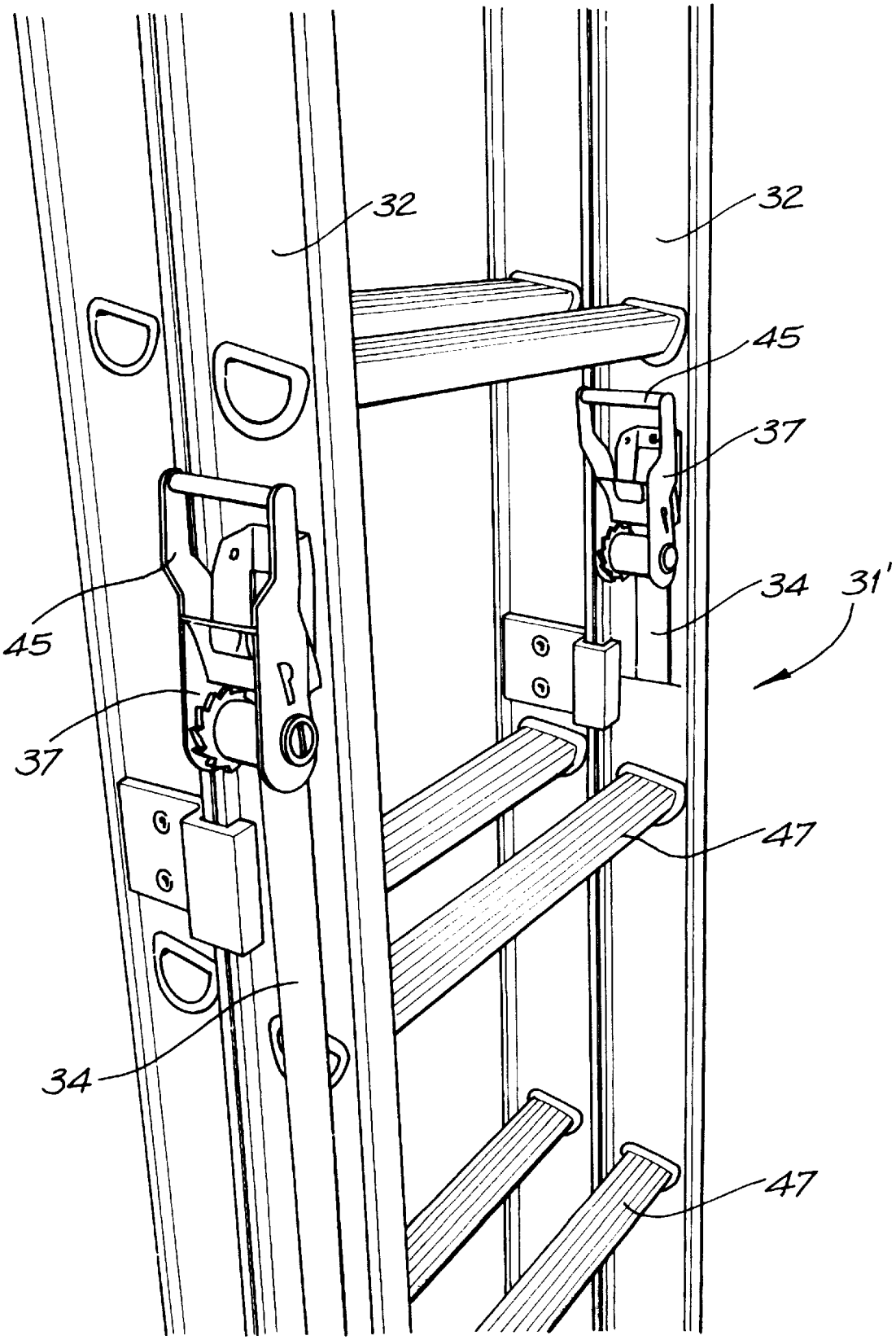
FIG. 8 is a detailed perspective view of an alternate embodiment of the invention, namely an extension ladder comprising a pair of leg extension mechanisms, showing the ratchet located both internally and externally.
Figure 9:
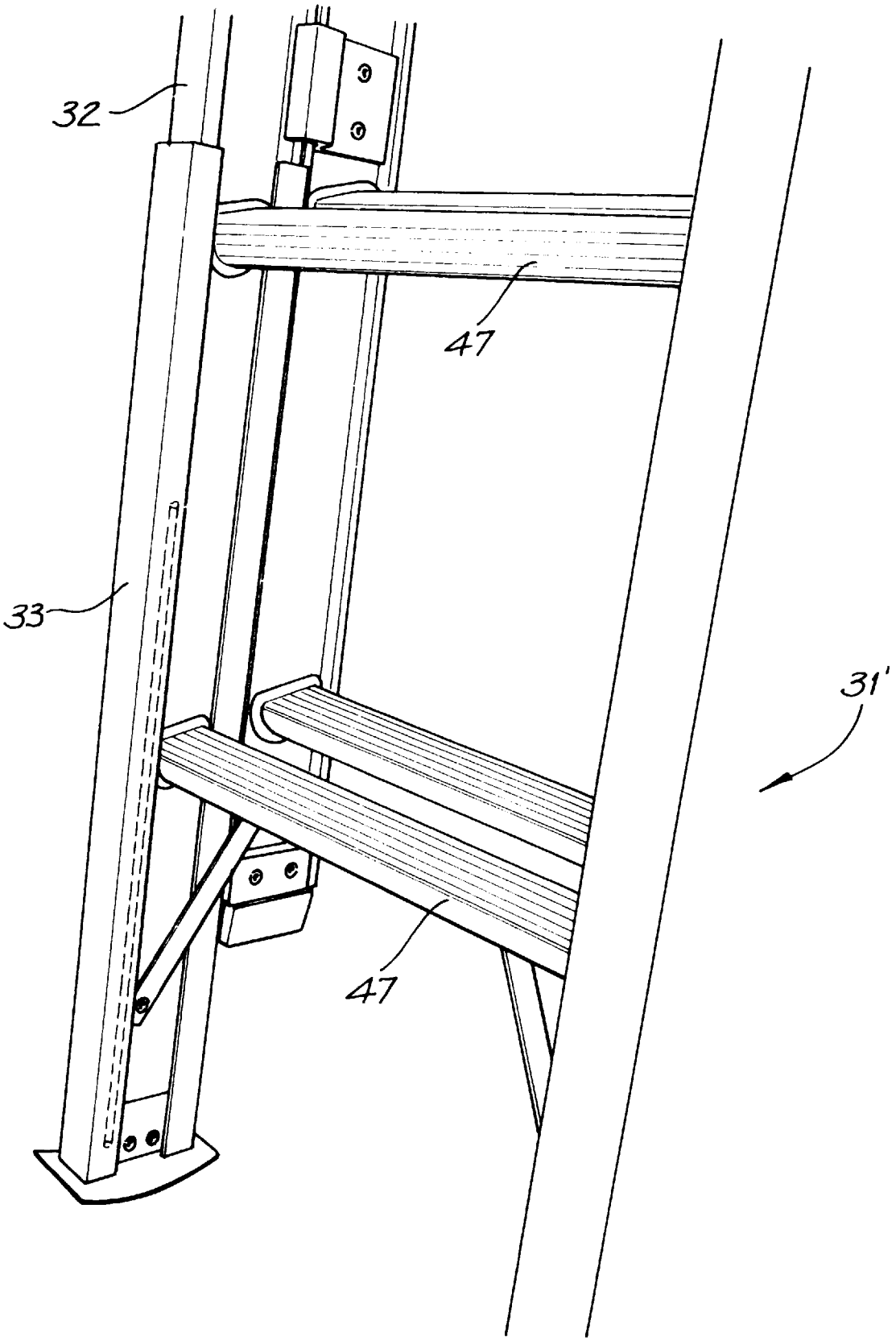
FIG. 9 is a detailed perspective of the embodiment shown in FIG. 8, detailing the extending leg member.

Referring now to FIGS. 8 and 9, there is illustrated a second embodiment of the invention, namely an extension ladder incorporating leg extension means in accordance with the invention. Like parts to those illustrated in FIGS. 3 to 7 are provide with the same reference numerals. Thus there is shown in this embodiment an extension ladder generally referenced 31'. The ladder 31' comprises first leg members 32 and second extending leg members 33 in this embodiment located about the first leg member 32 rather than inside of it, with steps or treads 47 located between the respective left and right leg members 32. Other parts of the ladder 31' not relevant to the invention are not referenced. Located between the respective first (32) and second extending leg members (33) are straps 34 fixedly attached at points (not shown) adjacent the upper ends of the extending leg members 33 by suitable means. The straps 34 pass from there around guides (also not shown in these figures) and thence to respective ratchet devices 37, located at a suitable position on the first leg members 32.

The ratchet devices 37 are shown in more detail in FIG. 8, in which it will be observed that actuation of the respective ratchet by means of handle 45 will cause the strap 34 to be wound up ie shortened, causing the respective extending leg members 33 to extend. The straps 34 will be held in this position by virtue of the appropriate orientation of the ratchet mechanisms 37, the straps 34 remaining in tension as a result of the influence of springs (again not illustrated) or the weight of the ladder 31' itself in use. When ratchets 37 are released, it will allow the extending members 33 under the influence of the return springs and/or the load exerted by the ladder 31' in use, to pull against the unrestrained straps 34 and to retract, thereby shortening the overall length of each leg of the ladder 31'.

The advantages of the present invention, particularly in relation to its incorporation in a step ladder and to a lesser degree an extension ladder is that adjustment is achieved at a convenient height allowing safer levelling of the ladder. The ladder may also have an in-built level indicating device to further increase its safety. Actuation of the extensions is achieved by using tensile straps/cables from a ratchet mechanism and passing around a return roller. This enable continuous adjustment of the leg. The device's use is not limited to ladders but has other applications such as scaffolding, saw horses, strutting devices, adjustable work tables.

The foregoing describes only some embodiments of the present invention, and modifications obvious to those skilled in the art can be made thereto without departing from the scope of the present invention.

What is claimed is:

1. A leg extension means providing independent extension for a single leg, for use in levelling a ladder or a work platform, and providing variable extension to the single leg, comprising a first leg member and a second single extending leg member substantially parallel with, and in slidable relation to, a strap cooperating therebetween, and means for clamping and positively extending while under load said strap for securing said strap in a fixed, tensioned position for producing an extendable leg securable over a range of extended lengths and wherein said means for clamping and positively extending while under load said strap is able to be activated for positively extending, under load, said second single extending leg member and for securing and releasing, as required, said strap for fixing the length of the second single extendable leg member, thereby allowing adjustment of the second single extending leg member, independently of any other possible adjustment of another leg member of the ladder or work platform, for accommodating variations in terrain on which the ladder or work platform is used.

2. A leg extension means providing independent extension for a single leg according to claim 1, wherein said leg extension means is telescopic in arrangement, the first leg member comprising a hollow tube for containing the second single extending leg member, so that in an unextended state, the second single extending leg member is substantially contained within the first leg member, while in a fully extended state, one end portion of the second single extending leg member remains within the first leg member and is supported thereby so that the second single extending leg member remains substantially rigid in use.

3. A leg extension means providing independent extension for a single leg according to claim 1, wherein leg extension means is telescopic in arrangement, the second extending leg member comprising a hollow tube or having other suitable cross section (for example a C-shaped cross section) to otherwise contain for containing the first leg member, so that in an unextended state, a length of the first leg member is substantially contained within the second single extending leg member, while in a fully extended state, one end portion of the second single extending leg member remains about a reduced length of the first leg member and is supported thereby so that the first leg member remains substantially rigid in use.

4. A leg extension means providing independent extension for a single leg according to claim 1, wherein the second single extending leg member is located adjacent and alongside the first leg member and slideable within hook-and-loop elements, fixedly attached and substantially perpendicular to the first leg member, the said hook-and-loop elements providing containment of the second single extending leg member to support the extended leg in use.

5. A leg extension means providing independent extension for a single leg according to claim 1, wherein said means for clamping and positively extending while under load is located on the first leg member rather than the extending leg member.

6. A leg extension means providing independent extension for a single leg according to claim 1, wherein the strap passes about a guide arrangement located on the same leg member as said means for clamping and positively extending while under load.

7. A leg extension means providing independent extension for a single leg according to claim 6, wherein said guide arrangement is a fixed bar located on said first leg member.

8. A leg extension means providing independent extension for a single leg according to claim 1, wherein said strap is fixedly attached by one end to a top portion of the second single extending leg member, the strap passing down the second single extending leg member, between the second single extending leg member and the first leg member while lies adjacent to it to maintain its stability, to the means for clamping and positively extending while under load which is located on the first leg member located towards a lower end of that first leg member.

9. A leg extension means providing independent extension for a single leg according to claim 1, wherein said strap is fixedly attached by one end to a top portion of the second single extending leg member, the strap passing down and around a fixed guide located on the first leg member, from whence said strap progresses upwards towards means for clamping and positively extending while under load located at a position on the first leg member for more convenient operation thereof, so that by pulling upwards on the strap in the vicinity of the means for clamping and positively extending while under load, the second single extending leg member is caused to travel downwards due, to the tension exerted by the strap, thereby extending the second single extending leg member, so that upon clamping the strap, the second single extending leg member will be restrained from a return, upwards movement.

10. A leg extension means providing independent extension for a single leg according to claim 1, wherein said means for clamping and positively extending while under load is a spool and ratchet device, capable of winding up the strap, so that, in use, operation of the ratchet device to wind up the strap causes the second single extending leg member to extend.

11. A leg extension means providing independent extension for a single leg according to claim 10, wherein the ratchet device operates in a first operating position to allow the spool to be rotated in one direction so that said strap is wound up with the consequence that the second single extending leg member extends downwards and causes the leg to be extended and, upon being left in such a position, the ratchet device secures the spool and hence the strap against slippage, thereby maintaining the leg in extended position, but wherein the ratchet device is able to be set in a second release position to release the spool and, consequently, the strap for retraction of the second single extending leg member.

12. A leg extension means providing independent extension for a single leg according to claim 1, in which retraction of the extending leg member is achieved by virtue of the weight of the ladder acting downwards on the second single extending leg member.

13. A leg extension means providing independent extension for a single leg according to claim 12, in which retraction of the extended leg member is facilitated by the use of a return spring to assist such return even when the ladder's own weight is not acting on the extended leg member.

14. A leg extension means providing independent extension for a single leg according to claim 12, wherein retraction of the extended leg member is facilitated by the use of an elastic cord to assist such return even when the ladder's own weight is not acting on the extended leg member.

15. A leg extension means providing independent extension for a single leg according to claim 1, wherein the means for clamping and positively extending while under load is located on the first leg member of the ladder, so that adjustment is achieved by an operator operating the means for clamping while the operator is standing on the ground adjacent the ladder to be levelled.

16. A leg extension means providing independent extension for a single leg according to claim 1, wherein said strap is a belt.

17. A leg extension means providing independent extension for a single leg according to claim 1, wherein said strap is a cable.

18. A leg extension means providing independent extension for a single leg according to claim 1, wherein said strap is made of nylon.

19. A leg extension means providing independent extension for a single leg according to claim 1, further comprising a ladder in combination with, and integral with, said leg extension means.

20. A leg extension means providing independent extension for a single leg according to claim 1, further comprising a ladder in combination with, and fixedly attached to, said leg extension means.

* * * * *